313-414 SR

2/15/83 OR 4,374,342

United States Patent [19]

Say

[11] 4,374,342

[45] Feb. 15, 1983

[54] FOCUSING MEANS IN A UNITIZED BI-POTENTIAL CRT ELECTRON GUN ASSEMBLY

[75] Inventor: Donald L. Say, Waterloo, N.Y.

[73] Assignee: North American Philips Consumer Electronics Corp., New York, N.Y.

[21] Appl. No.: 197,312

[22] Filed: Oct. 15, 1980

[51] Int. Cl.[3] ..... H01J 29/50; H01J 29/56

[52] U.S. Cl. ..... 313/414

[58] Field of Search ..... 313/414, 412

[56] References Cited

U.S. PATENT DOCUMENTS

| | | | |
|---|---|---|---|
| 4,086,513 | 4/1978 | Evans, Jr. | 313/414 |
| 4,208,610 | 6/1980 | Schwartz | 313/414 |
| 4,275,332 | 6/1981 | Ashizaki et al. | 313/414 |

FOREIGN PATENT DOCUMENTS

| | | | |
|---|---|---|---|
| 52-51863 | 4/1977 | Japan | 313/412 |
| 54-13769 | 2/1979 | Japan | 313/414 |

*Primary Examiner*—Palmer C. Demeo

*Attorney, Agent, or Firm*—Thomas A. Briody; Jack Oisher; John C. Fox

[57] ABSTRACT

A structural beam focusing improvement is introduced into the main focusing electrode of at least one of the gun structures in a CRT plural beam bi-potential in-line electron gun assembly. This improvement, being in the form of a pair of sideboard elements, one of which is positioned on either side of a forward aperture in the unitized main focusing electrode, imparts correctional influences to asymmetries in the respective lensing field, thereby resulting in the achievement of a desired circular beam spot landing at the center of the screen.

7 Claims, 8 Drawing Figures

FOCUSING MEANS IN A UNITIZED BI-POTENTIAL CRT ELECTRON GUN ASSEMBLY

CROSS REFERENCE TO RELATED APPLICATION

Filed concurrently with this application and assigned to the assignee of the present invention, is an application Ser. No. 197,308, which pertains to a beam focusing improvement in a CRT plural beam tri-potential in-line electron gun assembly.

TECHNICAL FIELD

This invention relates to electron guns for color cathode ray tubes and more particularly to means for modifying the lensing field associated with the main focusing of the electron beam in a unitized bi-potential gun.

BACKGROUND OF THE INVENTION

In color television and allied display applications, it is conventional practice to utilize cathode ray tubes of the type employing a patterned multi-phosphor cathodoluminescent screen interiorly disposed on the viewing panel of the tube envelope wherein an apertured or multi-opening mask member is spatially oriented relative thereto. A plurality of electron beams, emanating from an electron gun assembly, positioned within the neck portion of the envelope, are directed to converge at and traverse the apertured mask to impinge and luminescently excite the electron responsive phosphors comprising the patterned screen therebeyond. Focusing of the respective electron beams is conventionally achieved by means of discrete electron lensing; as for example, bi-potential focus lensing, such being dependent on the ratio of the focus voltage (G3) to the accelerating electrode or anode voltage (G4). With the advance of cathode ray tube technology, there has been a trend toward miniaturization and compaction of electron gun structures, which in turn, are encompassed within envelope neck portions of smaller diameters and shorter lengths. Consequently, the dimensionings and constructions of the electrode elements of the multi-gun assembly have been adapted to achieve the desired compaction. Such is especially evident in the conventional in-line plural gun assembly, wherein three separate electron beams emanate in a substantially common horizontal plane. This is accomplished by employing a unitized construction, in which several of the respective electrode elements, ahead of the individual cathodes, are unitized electrode members of definitive construction, each bearing at least one plane with three spatially-related in-line apertures therein.

While this unitized construction is beneficial in achieving the described structural results, it has been noted in a bi-potential gun assembly, that one or more of the beam landing spots at the center of the screen often tend to be of an ovate cross-sectional shaping, rather than the desired circular shape. This is particularly noticed relative to the beam projected by the center gun of the assembly, and appears to be the result of structural influences inherent in the unitized construction which introduce asymmetries into the beam lensing field effected within the main focusing electrode. The resultant focused ovate shaping of the beam landing area, at screen center, is deleterious to picture resolution in the screen display.

DISCLOSURE OF THE INVENTION

It is therefore an object of this invention to reduce and obviate the aforementioned disadvantages evidenced in the prior art. Another object of the invention is the provision of a structural modification in the main focusing electrode (G3) to impart a correctional influence to the main lensing field, thereby producing a substantially circular beam landing spot at screen center.

These and other objects and advantages are accomplished in one aspect of the invention by providing an improvement in the main focusing electrode (G3) which is a unitized element having a longitudinal dimension defined between rear and forward apertured ends. The improvement relates to at least one of the forward apertures thereof and is in the form of a pair of inserts of substantially planar metallic "sideboard-like" elements oriented within the electrode, in standing parallel positions, substantially perpendicular to the interior surface of the forward end thereof. These two "sideboards" are positioned one on either side of the respective forward aperture to impart a corrective influence to the main focusing of the beam.

When the center-of-screen ovate cross-sectional shaping of the focused beam evidences a major axis that is substantially coincidental with the horizontal plane of the gun assembly, the sideboard elements are positioned in parallel planes substantially vertical to the horizontal plane of the gun assembly.

Such improvements added internally to the forward portion of the main focusing electrode (G3), provide correction to the main lensing field thereby effecting a focused beam landing spot at the center of the screen that is desirably substantially circular in shape.

BEST MODE FOR CARRYING OUT THE INVENTION

For a better understanding of the present invention together with other and further objects, advantages and capabilities thereof, reference is made to the following disclosure and appended claims taken in conjunction with the aforedescribed drawings.

Figure 1:
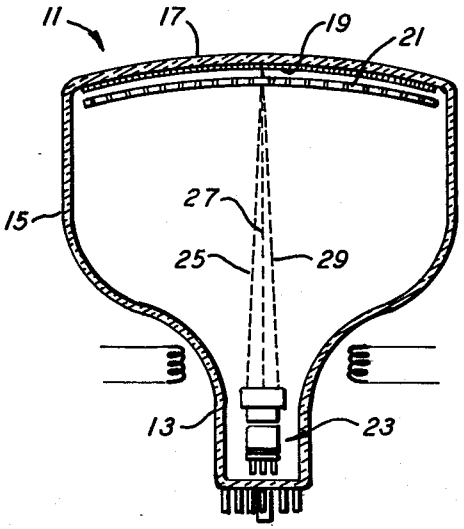
FIG. 1 is a cross-sectional view of a cathode ray tube wherein the invention is utilized.

With reference to FIG. 1, the essentials of a plural inline beam color cathode ray tube construction 11 are shown in cross-section. The encompassing envelope is comprised of an integration of neck 13, funnel 15 and viewing panel 17 portions. Disposed on the interior surface of the viewing panel is a patterned cathodoluminescent screen 19 formed as a repetitive array of definitive stripes or dots of color-emitting phosphor components, such being in keeping with the state of the art. A multi-opening structure 21, in this instance a shadowmask, is positioned within the viewing panel in spatial relationship to the patterned screen; such being located within the panel by conventional means, not shown.

Positionally encompassed within the envelope neck portion 13, is a unitized multi-beam in-line electron gun assembly 23, comprised of an integration of three bi-potential gun structures. The guns of this unitized assembly form and direct three separate electron beams 25, 27 and 29 to discretely impinge the patterned screen 19. It is within this electron gun assembly 23 that the improvement of the invention resides.

Figure 2:
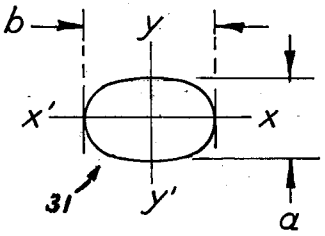
FIG. 2 Prior Art
FIG. 2 is a prior art view of an ovately-shaped beam landing spot at the center of the screen.

Because of inherent structural influences relating to compaction, an integrated assembly of in-line bi-potential electron guns often produces focused beam landings at the center of the screen that are of ovate cross-sectional shaping instead of the desired circular shape. This is more often evidenced in the focused beam from the center of the in-line guns. An exemplary beam spot landing area of the ovate type is shown in FIG. 2, wherein the spot area 31 is oriented relative to the X-Y coördinate axes of the screen 19. As such, the focused ovate shaping evidences a major axis (X—X') which is oriented in substantially coincidental relationship with the horizontal plane 30 of the gun assembly 23. While the dimensional characteristics of this referred to ovate shaping may vary due to structural influencing conditions, the ratio of the minor "a" to the major "b" dimensions may be considered aggravative to picture resolution when in the order of for example: 1.0 to 1.2.

To fully understand the marked significance of the invention, attention is directed to FIGS. 3 through 7 wherein the plural beam bi-potential in-line gun assembly 23 is illustrated in greater detail. This plural gun multi-electrode structure is unitized, in that, the in-line apertures for the three guns are contained in a common member for each of the respective electrode elements, as exemplarily phantomed in FIG. 3. Each of the respective in-line oriented beams 25, 27 and 29 transverses a substantially longitudinal arrangement of several functionally related electrode members. For example, sequentially positioned ahead of individual cathode elements 35, 37 and 39, is a unitized initial beam forming electrode (G1) 41, wherein the beam is shaped to be substantially circular in cross-section, an initial beam accelerator electrode (G2) 43, a main focusing electrode (G3) 45, and a final accelerator electrode (G4) 47. Terminally positioned on the open forward portion of the final accelerator is a common plural apertured convergence cup member 49 wherein shunts and/or enhancers may be located in accordance with the known state of the art. The several unitized electrodes comprising the in-line gun assembly 23 are conventionally positioned and held in spaced relationship with respect to one another by a plurality of insulative support rods, which for purposes of clarity are not shown.

The main focusing electrode (G3) 45 is a box-like structure having a longitudinal dimension "L" defined between rear and forward apertured ends 51 and 53 thereof. The structure is usually fabricated of two slightly flanged cup-like parts, i.e., a rear portion 55 and a forward portion 57, of which the flanges are mated and joined as by welding. The respective forward in-line apertures 59, 61 and 63, being substantially circular in shape, are often individually defined by peripherally inturned projections, such as 65, 67 and 69.

In the final accelerator electrode (G4) 47, the in-line apertures 71, 73 and 75, being related to the respective apertures in the main focusing electrode (G3) 45, in shape and orientation, likewise often have peripherally inturned projections 77, 79 and 81.

For purposes of illustration, the center gun of the unitized gun assembly will be considered in greater detail, as the electron beam 27 emanating therefrom is more prone to exhibit a focused center-of-screen ovate shaping, such as that shown in FIG. 2. While the beam is comprised of a definitive bundle of moving rays of electrons, having a substantially circular cross-sectional area, it is indicated in the Figures as a single line for purpose of simplicity.

Figure 3:
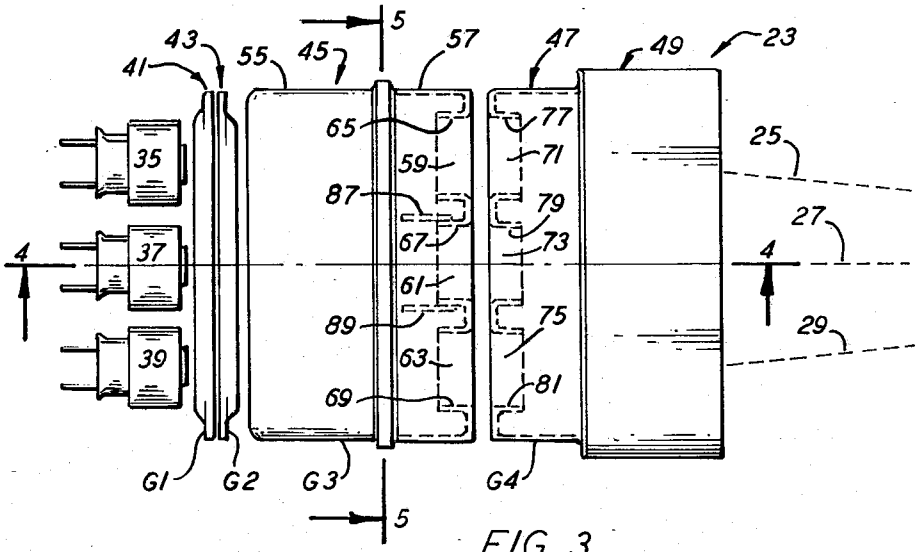
FIG. 3 is an illustration of a unitized bi-potential inline plural beam electron gun assembly of the type utilized in FIG. 1.
Figure 5:
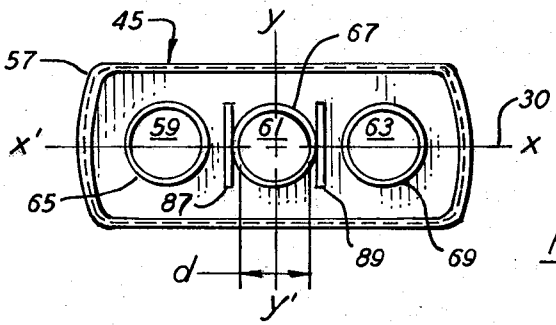
FIG. 5 is a plan view of the forward portion of the unitized main focusing electrode (G3) of the gun assembly, taken from the plane 5—5 in FIG. 3.
Figure 4:
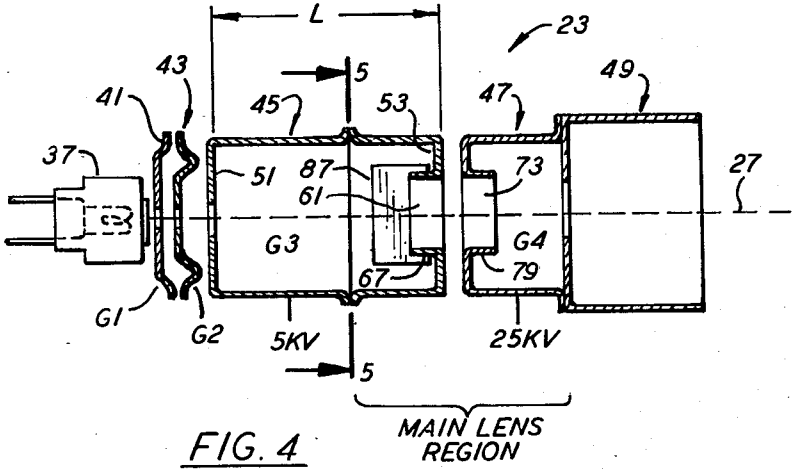
FIG. 4 is a sectional view of the center gun structure thereof taken along the line 4—4 in FIG. 3.

In referring to FIGS. 3 and 4, the final focusing of the beam 27 is accomplished by the lensing formed interspatially between the main focusing (G3) and final accelerator (G4) electrode 45 and 47, the influencing fields of which extend through the apertures into the respective electrodes. As previously mentioned, inherencies in the unitized construction tend to introduce asymmetrics into the main lensing field. These abnormal influences may, for instance, effect more focusing in the vertical plane than in the horizontal, thereby producing a horizontally oriented ovate beam landing spot on the screen.

Since the focusing electrode (G3) 45 is of lower potential (5 KV) than the adjacent accelerator electrode (G4) 47 (25 KV), the electron beam 27 moves at a much slower speed through the "G3" electrode than it does through the adjacent "G4" electrode. As a result, substantially 70 to 90 percent of beam focusing is achieved in the "G3" portion of the lensing field. Therefore, any asymmetries introduced into the "G3" field exert greater influences on the beam focusing than does the subsequent "G4" field, wherein the beam passes through at an accelerated speed and is thus more immune to field asymmetrics therein.

Figure 6:
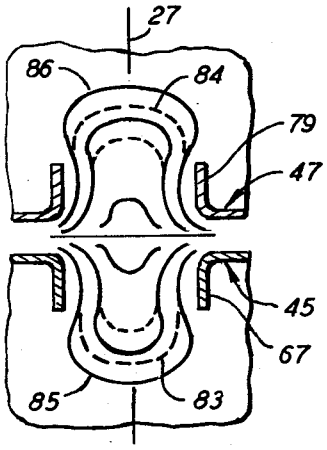
FIG. 6 Prior Art
FIG. 6 is a prior art sectional of adjacent apertures in main focusing (G3) and final accelerator (G4) electrodes illustrating the equipotential lines in the main lensing field.

FIG. 6 is a prior art sectional of the main lens focusing section depicting exemplary equipotential lines in the lensing field associated with both the focusing electrode 45 and the adjacent accelerating electrode 47. The broken lines 83 and 84, in the respective electrodes, indicate the more-confinedequipotential lines relating to focusing of the beam 27 in the vertical (Y-Y') plane, while the solid somewhat misshapened lines 85 and 86 relate to the equipotential lines effecting focusing in the horizontal (X-X') plane. The asymmetries introduced into the horizontal planes of the main lensing field, by the respective equipotential lines 85 and 86, result in the broader focused ovate shaping of the beam.

It has been found that the desired circular center-of-screen beam landing spot can be achieved by introducing a modifying influence into the horizontal plane of the lensing field in the main focusing electrode 45. This improvement is in the form of a pair of inserts of substantially planar metallic "sideboard" elements 87, 89 oriented within the focusing electrode 45 in standing parallel relationship, one on either side of the forward aperture 61 and normal to the horizontal plane 30 of the gun assembly. Exemplarily, these elements are substantially rectangular in shape. As such, the sideboard elements project inwardly within the focusing electrode, being substantially perpendicular to the interior surface of the forward end 53 thereof. As exemplarily shown, the sideboard elements are affixed to inturned aperture projection 67. While the inward distance of projection or penetration "p" of these sideboard elements 87, 89 from the interior surface of the forward end is the controlling factor for determining the degree of field corrections, it need not substantially exceed the diametrical dimension "d" of the related forward aperture 61. In a related manner, the length "k" of the respective sideboard elements need not substantially exceed the diametrical dimension "d" of the respective aperture.

Figure 7:
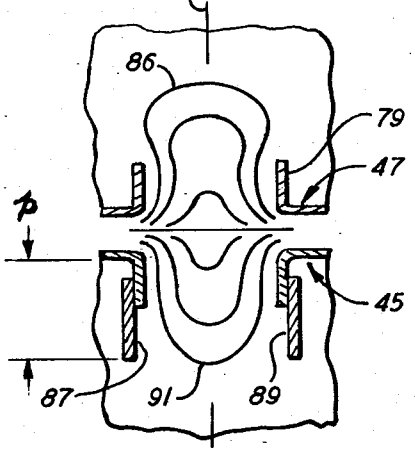
FIG. 7 is a related sectional view showing correctional influences on the lensing field effected by the added sideboard elements to the aperture in the main focusing electrode (G3)

The influence of the sideboard elements, within the "G3" electrode, is evidenced in FIG. 7 wherein the modified equipotential lines 91, effecting more focusing in the horizontal (X-X') plane, are shown. The equipotential lines 83, effecting focusing in the vertical (Y-Y') plane, remain unchanged, as indicated in FIG. 6. Therefore, the vertical field lines 83 and the modified horizontal field lines 91, being substantially similar in contour, constitute a substantially symmetrical lensing field in the main focusing electrode 45. This results in the desired focusing of a substantially circular beam landing area at the center of the screen 19. The lensing field within the "G4" accelerating electrode remains substantially unchanged, but, as previously mentioned, it exerts minimal effect in focusing the electron beam rapidly accelerating therethrough.

Figure 8:
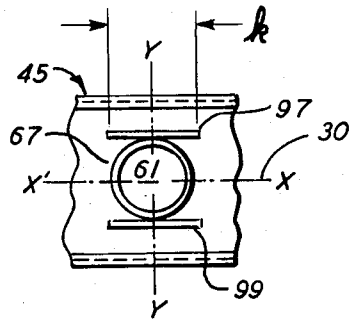
FIG. 8 is a partial plan view of the forward portion of the main focusing electrode (G3) taken in an orientation similar to that of FIG. 5, showing re-positioning of the sideboard elements.

While in most prior art situations the ovate cross-sectional focused beam at the center of the screen evidences a major axis oriented in substantially coincidental relationship with the horizontal plane 30 of the gun assembly, as heretofore described, due to constructional-related disturbances introduced into the vertical field, there are a few instances when the ovate landing configuration is rotated substantially 90 degrees from the described orientation. In such occasions, the major axis of the ovate shaping is substantially vertical to the horizontal plane of the gun assembly. When such occurs, the sideboard elements 97 and 99, as shown in FIG. 8, are positioned in parallel planes, one on either side of the forward "G3" aperture 61, in locations substantially parallel with the horizontal plane 30 of the gun assembly 23. Having the sideboards so oriented provides the needed confinement of the equipotential lines in the vertical plane (Y-Y') of the lensing field, thereby imparting more focusing action in the vertical plane to achieve symmetrical lensing and thus provide the desired consequential circular beam spot landing at the center of the screen.

While the sideboard elements have been described as exemplarily utilized in the center gun of the bi-potential assembly 23, they are equally adaptable to usage in any or all of the in-line gun structures therein, if need for correction of the respective beam focusing is evidenced.

INDUSTRIAL APPLICABILITY

The beam focusing improvement, for unitized bi-potential in-line electron gun structures, is an advancement of merit thereby obviating the focusing disadvantages evidenced in the prior art. The utilization of sideboard elements, with one or more of the forward apertures in the main focusing electrode (G3), is both an expeditious and economical practice to effect correction of constructional-induced asymmetries often inherent in the main lensing fields of unitized assemblies.

I claim:

1. A beam focusing improvement in a CRT plural beam bi-potential in-line electron gun assembly embodying a center and two side-related guns for use in a color tube having a forwardly positioned cathodoluminescent screen, each of said guns having a beam path axis therethrough oriented in a common horizontal plane, said gun assembly being a construction of unitized in-line apertured electrode members sequentially positioned forward of individual electron producing cathode elements to provide for each gun an initial beam forming electrode (G1), an initial beam accelerator electrode (G2), a main focusing electrode (G3) having a longitudinal dimension defined between rear and forward apertured ends, and a final accelerator electrode (G4); said improvement relating to means for modifying the lensing field associated with the main focusing of the electron beam traversing at least one of said guns wherein the inherent substantially ovate cross-sectional shaping of the beam is modified to provide a focused substantially circular beam spot at the center of said screen; said improvement comprising: a pair of inserts in the form of substantially planar metallic sideboard elements oriented in standing parallel positions in a manner to project inwardly within said final focusing electrode (G3) and being substantially perpendicular to the interior surface of said forward end thereof, one of said sideboard elements being oriented on either side of the respective forward aperture in a manner to adjust positioning of the equipotential lines inherent in the main lensing field spatially formed within the region to provide substantially symmetrical lensing for the main focusing of said respective electron beam.

2. The CRT beam focusing improvement according to claim 1 wherein the forward apertures of the unitized main focusing electrode (G3) are circular in shape and individually defined by peripherally in-turned projections extending perpendicularly from the interior surface of the forward end thereof, and wherein said sideboard elements are oriented as in-standing parallel extensions of at least one of said apertural projections.

3. The CRT beam forming improvement according to claim 2, in the instance wherein said ovate cross-sectional focused shaping of said beam resultant of the normal inherency of said main focusing region evidences a major axis oriented in substantially coincidental relationship with the horizontal plane of said gun assembly, said improvement being effected by positioning said sideboard elements in parallel planes substantially normal to the horizontal plane of said gun assembly.

4. The CRT beam focusing improvement according to claim 2, in the instance wherein said ovate cross-sectional focused shaping of said beam resultant of the normal inherency of said main focusing region evidences a major axis oriented substantially vertical to the horizontal plane of said gun assembly, said improvement being effected by positioning said sideboard elements in parallel planes substantially parallel with the horizontal plane of said gun assembly.

5. The CRT beam focusing improvement according to claim 1 wherein the inward distance of projection "p" of said sideboard elements from the interior surface of said forward end of said main focusing electrode (G3) need not substantially exceed the diametrical dimension "d" of said respective related forward aperture.

6. The CRT beam focusing improvement according to claim 1 wherein the length dimension "k" of said sideboard elements need not substantially exceed the diametrical dimension "d" of said respective related forward aperture.

7. The CRT beam focusing improvement according to claim 1 wherein said sideboard elements are substantially rectangular in shape.

* * * * *